US008126361B2

(12) United States Patent
Nakano

(10) Patent No.: US 8,126,361 B2
(45) Date of Patent: Feb. 28, 2012

(54) IMAGE FORMING APPARATUS WITH COMBINED BELT UNIT AND SHEET GUIDE MEMBER

(75) Inventor: Hiroshi Nakano, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 1172 days.

(21) Appl. No.: 11/505,944

(22) Filed: Aug. 18, 2006

(65) Prior Publication Data

US 2007/0048010 A1 Mar. 1, 2007

(30) Foreign Application Priority Data

Aug. 25, 2005 (JP) ..... 2005-244499

(51) Int. Cl.
*G03G 15/06* (2006.01)

(52) U.S. Cl. ..... 399/121

(58) Field of Classification Search ..... 399/121, 399/124

See application file for complete search history.

(56) References Cited

U.S. PATENT DOCUMENTS 5,652,942 A * 7/1997 Iseki et al. ..... 399/21

(Continued)

FOREIGN PATENT DOCUMENTS

JP 10-198118 7/1998

(Continued)

OTHER PUBLICATIONS

Machine Translation of JP 10-319731, cited by Applicant in IDS dated Jul. 31, 2008.*

(Continued)

*Primary Examiner* — Mark R Gaworecki
(74) *Attorney, Agent, or Firm* — Banner & Witcoff, Ltd.

(57) ABSTRACT

A laser printer has an opening formed at its front surface side and a front cover for opening and closing the opening. A belt unit is attachably and detachably provided with respect to a body casing via the opening in a state where the front cover is opened. A guide member for guiding a sheet of paper is provided at the front of the belt unit. The belt unit is combined with the guide member, which is provided to be attachable and detachable with respect to the body casing.

11 Claims, 13 Drawing Sheets

U.S. PATENT DOCUMENTS

| | | | | |
|---|---|---|---|---|
| 5,787,326 | A * | 7/1998 | Ogawa et al. | 399/124 |
| 6,708,011 | B2 * | 3/2004 | Nomura et al. | 399/110 |

FOREIGN PATENT DOCUMENTS

| | | |
|---|---|---|
| JP | 10-319731 A | 12/1998 |
| JP | 2000-275987 | 10/2000 |
| JP | 2002-108172 | 4/2002 |
| JP | 2002-131997 | 5/2002 |
| JP | 2004-302375 | 10/2004 |

OTHER PUBLICATIONS

CN Office Action dtd May 9, 2008, CN Appln. 2006101261466.

* cited by examiner

IMAGE FORMING APPARATUS WITH COMBINED BELT UNIT AND SHEET GUIDE MEMBER

CROSS REFERENCE TO RELATED APPLICATION

This application claims priority from Japanese Patent Application No. 2005-244499 filed Aug. 25, 2005. The entire content of this priority application is incorporated herein by reference.

TECHNICAL FIELD

The present invention relates to an image forming apparatus.

BACKGROUND

A known image forming apparatus such as a laser printer employs an endless belt for the purpose of carrying a sheet of paper, performing an intermediate transfer and the like. The aforementioned belt is detachably installed as a unit in the device for maintenance, replacement and the like.

It is preferable to form the aforementioned belt unit as compact as possible for performing efficient and easy maintenance. If the belt unit as a whole is enlarged, there may be difficulties in attachment or detachment of the unit with respect to the device, and the attachment/detachment mechanism (for example, slide mechanism) has to be enlarged accordingly. A mere simplification of the belt unit structure, however, may cause difficulties in finding the portion to be gripped other than the belt. The possibility to cause the operator to come into contact with the belt becomes substantially high, which is likely to give the damage to the belt.

Thus, there is a need in the art for an image forming apparatus that allows easy attachment or detachment of a belt unit as well as excellent maintenance performance.

SUMMARY

The image forming apparatus as one aspect of the invention is provided with a storage portion that stores a recording medium, an ejection mechanism that ejects the recording medium stored in the storage portion, and an image forming portion that forms an image on the recording medium within a body casing. The recording medium ejected by the ejection mechanism is guided by a guide member toward a predetermined direction, and further carried toward the image forming portion by a belt unit. The belt unit includes a frame portion, a plurality of support rollers rotatably provided to the frame, and a carrier belt extended between the support rollers for carrying the recording medium guided by the guide member. The guide member and the belt unit are combined into a single unit so as to be attachable to and detachable from the body casing.

In the aforementioned structure, since the belt unit and the guide member have been combined into the single unit, the guide member, which functions as a portion for guiding the recording medium, can also function as the grip portion during attachment or detachment of the belt unit. The belt unit, thus, may be easily attached or detached, and the maintenance is improved.

BRIEF DESCRIPTION OF THE DRAWINGS

Illustrative aspects in accordance with the invention will be described in detail with reference to the following figures wherein.

DETAILED DESCRIPTION

A first example structure of the image forming apparatus as an aspect of this invention will be described referring to FIGS. 1 to 8.

Figure 1:
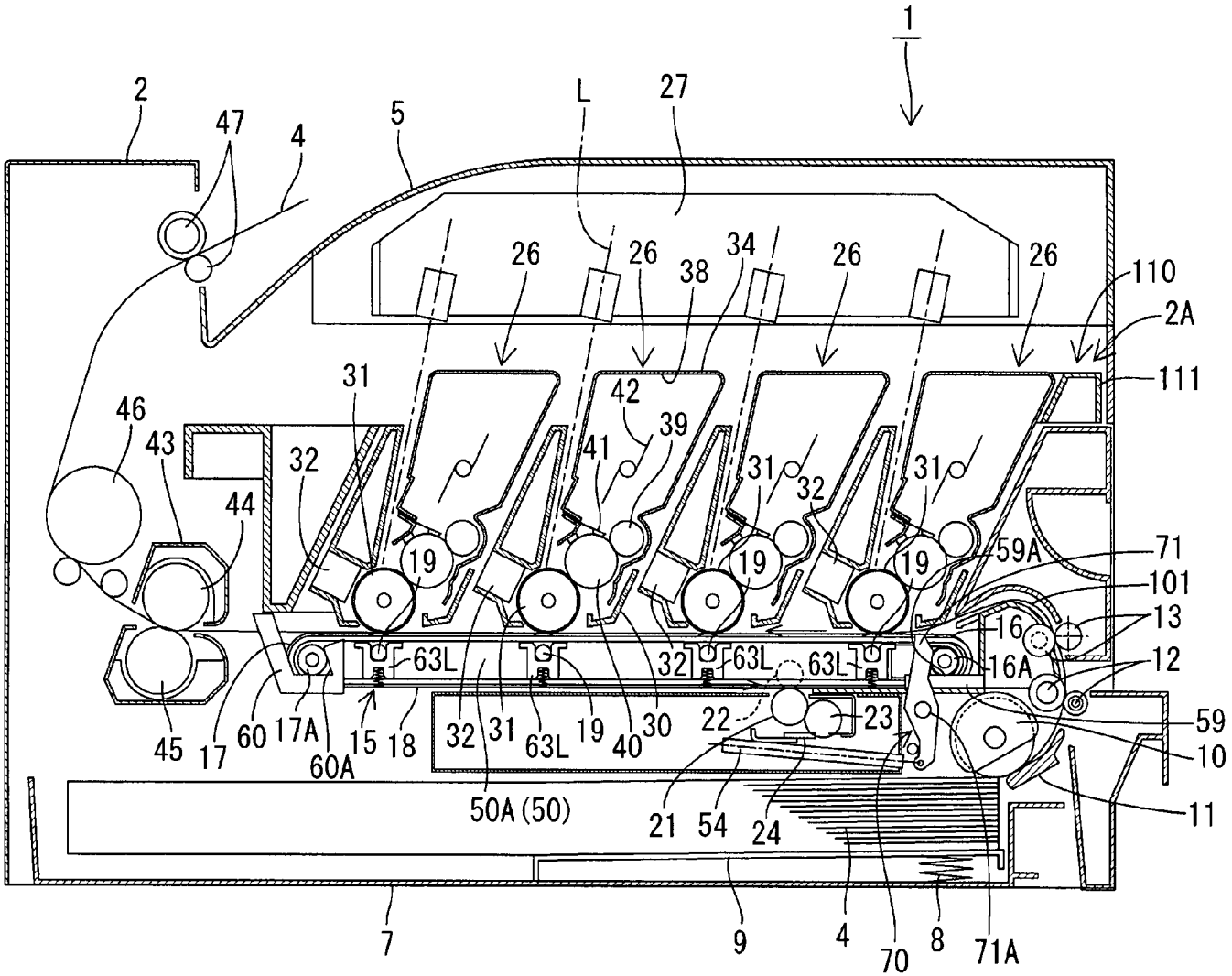
FIG. 1 is a sectional view schematically showing an example structure of a laser printer according to the present invention.
Figure 2:
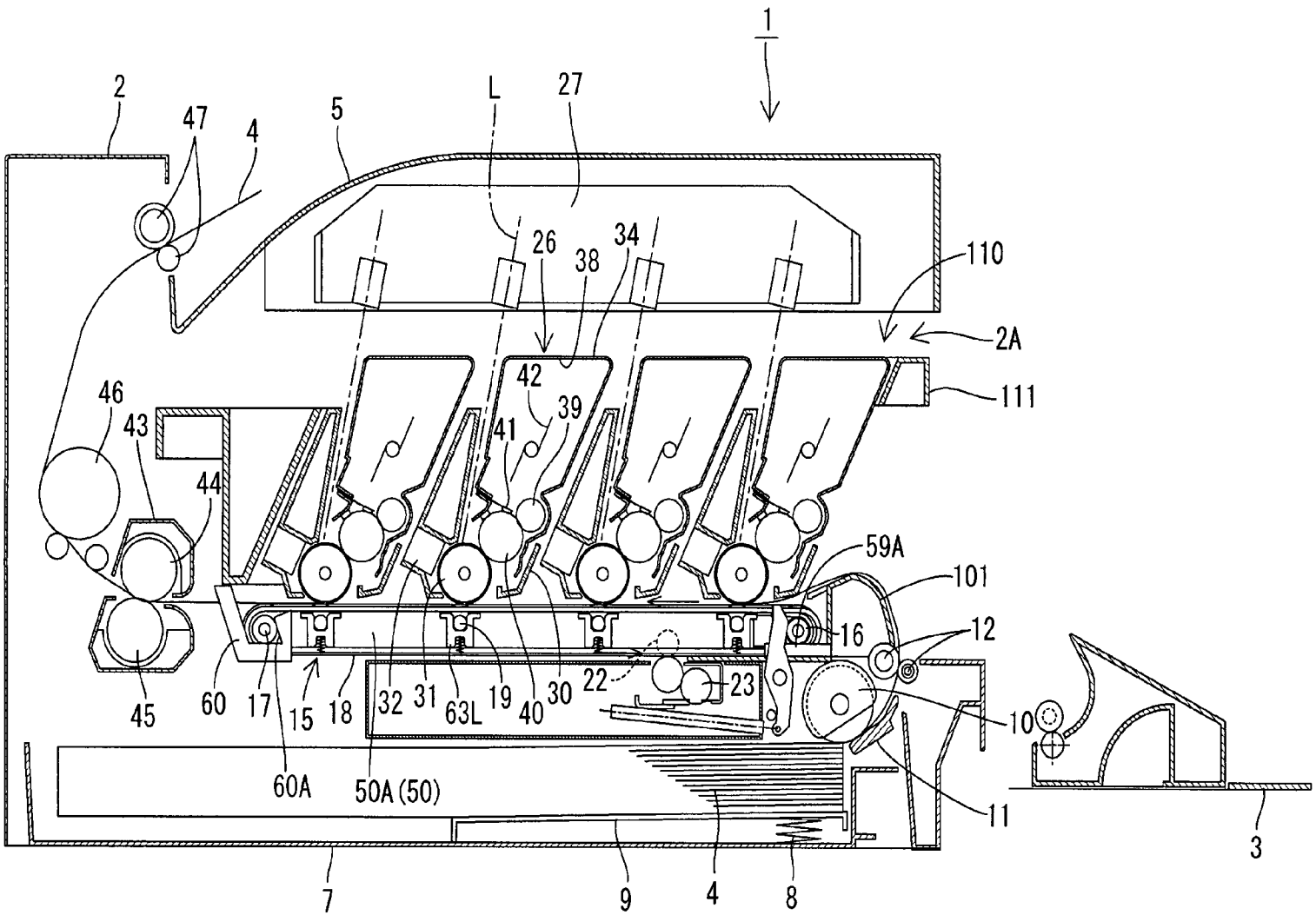
FIG. 2 is a sectional view of the laser printer shown in FIG. 1 having a front cover opened.

A laser printer 1, which is a color laser printer of direct transfer tandem type, includes a substantially box-like body casing 2 as shown in FIG. 1. A front cover 3 that can be opened and closed is attached to a front surface (right side of the drawing) of the body casing 2. Process cartridges 26 or a belt unit 15 within the body casing 2 may be replaced by opening the front cover 3 as shown in FIG. 2. An ejected paper tray 5 on which sheets of paper 4 that have been subjected to the image forming process are stacked is formed on the upper surface of the body casing 2.

A paper feed tray 7 on which the sheets of paper 4 subjected to the image forming process are stacked is set so as to be withdrawn forward. A platen 9 that is tiltably operated under the urging force of a spring 8 so as to lift up the front edge of the paper 4 is provided within the paper feed tray 7. A pick-up roller 10 and a separation pad 11 in pressure contact therewith under the urging force of a spring (not shown) are provided above the front end of the paper feed tray 7. A pair of paper feed rollers 12 are provided diagonally forward above the pick-up roller 10, and a pair of resist rollers 13 are further provided above the pair of paper feed rollers 12.

The upper most paper 4 among those stacked on the paper feed tray 7 is pressed toward the pick-up roller 10 by the platen 9. As the pick-up roller 10 rotates, the paper 4 is sandwiched between the pick-up roller 10 and the separation pad 11 so as to be separated and fed one by one. The paper 4 that has been fed from the sandwiched state between the pick-up roller 10 and the separation pad 11 is further carried to the resist rollers 13 by the paper feed rollers 12. The paper 4 is fed by the resist rollers 13 to the belt unit 15 backward thereof at a predetermined timing.

The belt unit 15 is structured to be attachable to and detachable from the body casing 2, and provided with a carrier belt 18 that horizontally extends between a pair of support rollers 16, 17, which are apart from each other in the front-rear direction. The support roller 17 at the rear is a drive roller that is rotated to be driven by power of a motor (not shown), and the support roller 16 at the front is a tension (driven) roller for applying a tensile force to the carrier belt 18, which will be described later. The carrier belt 18 is an endless belt formed of a resin material, for example, polycarbonate and the like. It is operated to circulate counterclockwise as shown in FIG. 1 when the support roller 17 as the drive roller is rotated to be driven such that the paper 4 placed on the carrier belt 18 is carried backward. Photosensitive drums 31 and four transfer rollers 19 each oppositely provided in the respective process cartridges 26 are arranged at constant intervals in a longitudinal direction at the inside of the carrier belt 18. The carrier belts 18 are, thus, interposed between the respective photosensitive drums 31 and the corresponding transfer rollers 19. During the transfer process, the transfer bias is applied between the transfer rollers 19 and the photosensitive drums 31, respectively. The structure of the belt unit 15 will be described later.

A cleaning roller 21 is provided below the belt unit 15 for removing toner or paper dust adhered to the carrier belt 18. The cleaning roller 21 is formed by applying a foaming material, for example, silicon around a metal shaft member, opposite to the metal back-up roller 22 provided on the belt unit 15 with respect to the carrier belt 18. A predetermined bias voltage is applied between the cleaning roller 21 and the back-up roller 22 such that the toner on the carrier belt 18 may be electrically introduced to the cleaning roller 21. The cleaning roller 21 abuts against a metal recovery roller 23 for removing the toner adhered thereon. The recovery roller 23 further abuts against a blade 24 that scratches to remove the toner adhered on the recovery roller 23.

Four process cartridges 26 corresponding to such colors as Magenta, Yellow, Cyan and Black, respectively are detachably arranged in the longitudinal direction above the belt unit 15. A scanner portion 27 provided above those process cartridges serves to irradiate a laser beam L corresponding to the respective colors onto a surface of the corresponding photosensitive drum 31 on the basis of the image data through rapid scanning.

The process cartridge 26 includes a cartridge frame 30, a photosensitive drum 31 and a scorotron type electrifier 32 provided below the cartridge frame 30, and a development cartridge 34 detachably set to the cartridge frame 30.

The photosensitive drum 31 is formed by coating a positively charged photosensitive layer formed of a polycarbonate, for example around a surface layer of a metal drum body that has been grounded.

The scorotron type electrifier 32 is provided diagonally backward above the photosensitive drum 31 such that they face with each other at a predetermined interval so as not to contact with each other. The scorotron electrifier 32 serves to positively electrify over a whole surface of the photosensitive drum 31 uniformly by causing the wire for charging, for example, tungsten, to generate a corona discharge.

The development cartridge 34 has a substantially box-like shape having a toner containing chamber 38 at the upper portion, and a supply roller 39, a development roller 40, and a layer thickness control blade 41 provided at the lower portion. Each of the toner containing chambers 38 contains non-magnetic single component toner that has been positively charged as the development agent for such colors as Yellow, Magenta, Cyan, and Black, respectively. Each of the respective toner containing chambers 38 is provided with an agitator 42 that agitates the toner.

The supply roller 39 is formed by coating a metal roller shaft with a conductive foaming material. The development roller 40 is formed by coating a metal roller shaft with a conductive rubber material. The toner discharged from the toner containing chamber 38 is supplied to the development roller 40 accompanied with the rotation of the supply roller 39, and positively friction charged between the supply roller 39 and the development roller 40. The toner supplied onto the development roller 40 proceeds between the layer thickness control blade 41 and the development roller 40 in conjunction with the rotation of the development roller 40 and is further friction charged sufficiently so as to be carried on the development roller 40 to form a thin layer with a uniform thickness.

The surface of the photosensitive drum 31 during rotation is uniformly charged positively by the scorotron electrifier 32. Thereafter it is exposed to rapid scanning of the laser beam from the scanner portion 27 such that the electrostatic latent image corresponding to the image to be formed on the paper 4 is generated.

Upon rotation of the development roller 40, the toner carried thereon that has been positively charged is brought into contact with the opposite photosensitive drum 31 such that the toner is supplied to the electrostatic latent image generated on the surface of the photosensitive drum 31. Accordingly the electrostatic latent image on the photosensitive drum 31 may be visualized, that is, the toner image is carried on the surface of the photosensitive drum 31.

The toner image carried on the surface of the respective photosensitive drums 31 is sequentially transferred on the paper 4 under the negative transfer bias voltage applied to the transfer rollers 19 while the paper 4 carried by the carrier belt 18 is fed through the respective transfer positions between the photosensitive drums 31 and the transfer rollers 19. The paper 4 on which the toner image has been transferred is fed to a fixation unit 43.

The fixation unit 43 is disposed to the rear of the carrier belt 18 within the body casing 2, and provided with a heat roller 44 including a heat source, for example, a halogen lamp, which is rotated to be driven, and a press roller 45 oppositely positioned to press the heat roller 44 and driven through rotation. The fixation unit 43 heats the paper 4 that carries the four-colored toner image while being sandwiched and carried between the heat roller 44 and the press roller 45 so as to fix the toner image on the paper 4. The thermally fixed paper 4 is carried to ejection rollers 47 at the upper portion of the body casing 2 by a carrier roller 46 diagonally backward above the fixation unit 43. The paper 4 is then discharged onto the ejected paper tray 5 by the ejection rollers 47.

The belt unit and peripheral structure thereof will be described in detail.

Figure 3:
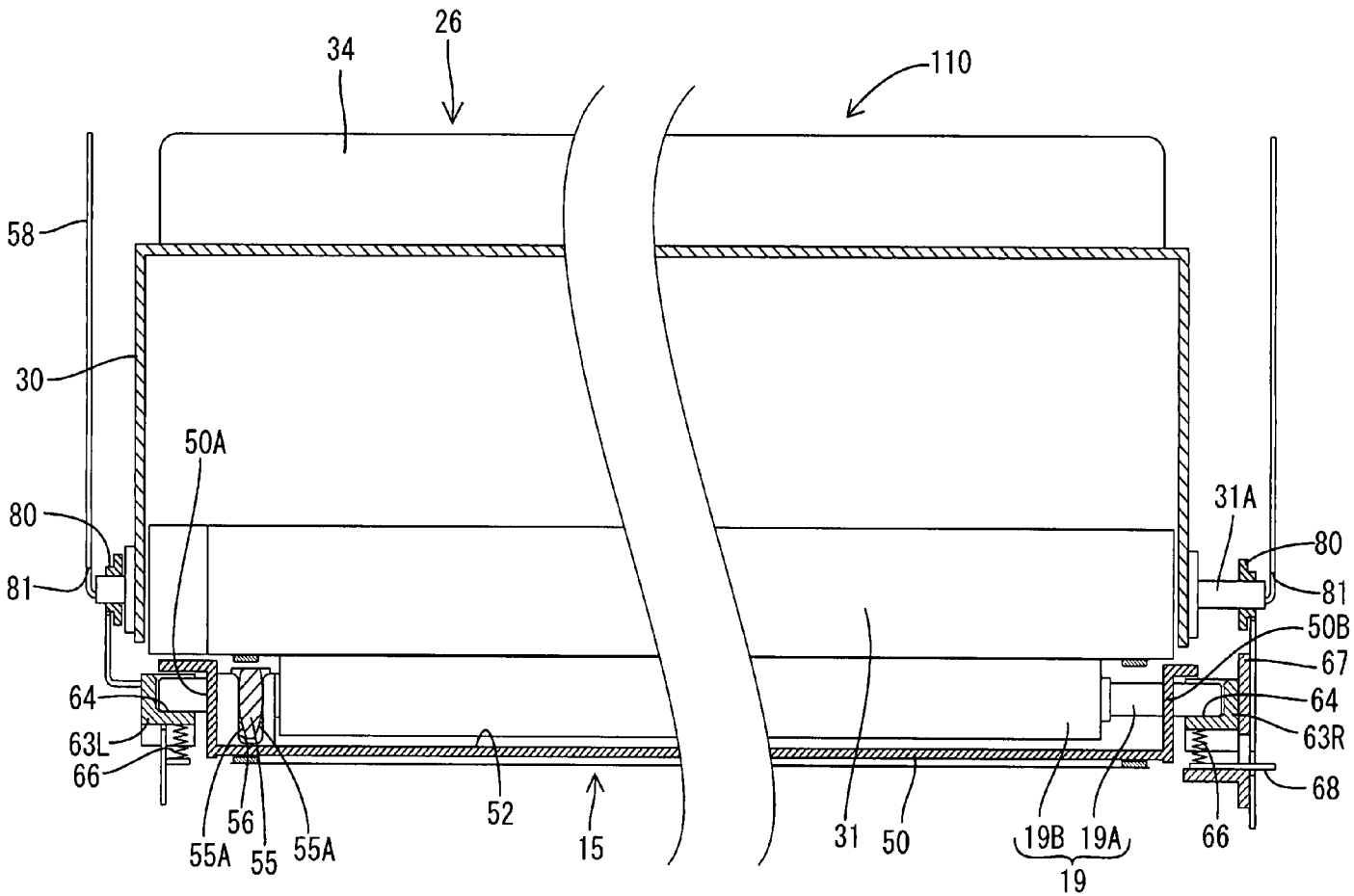
FIG. 3 is a front sectional view showing a support mechanism of a transfer roller and a photosensitive drum.
Figure 4:
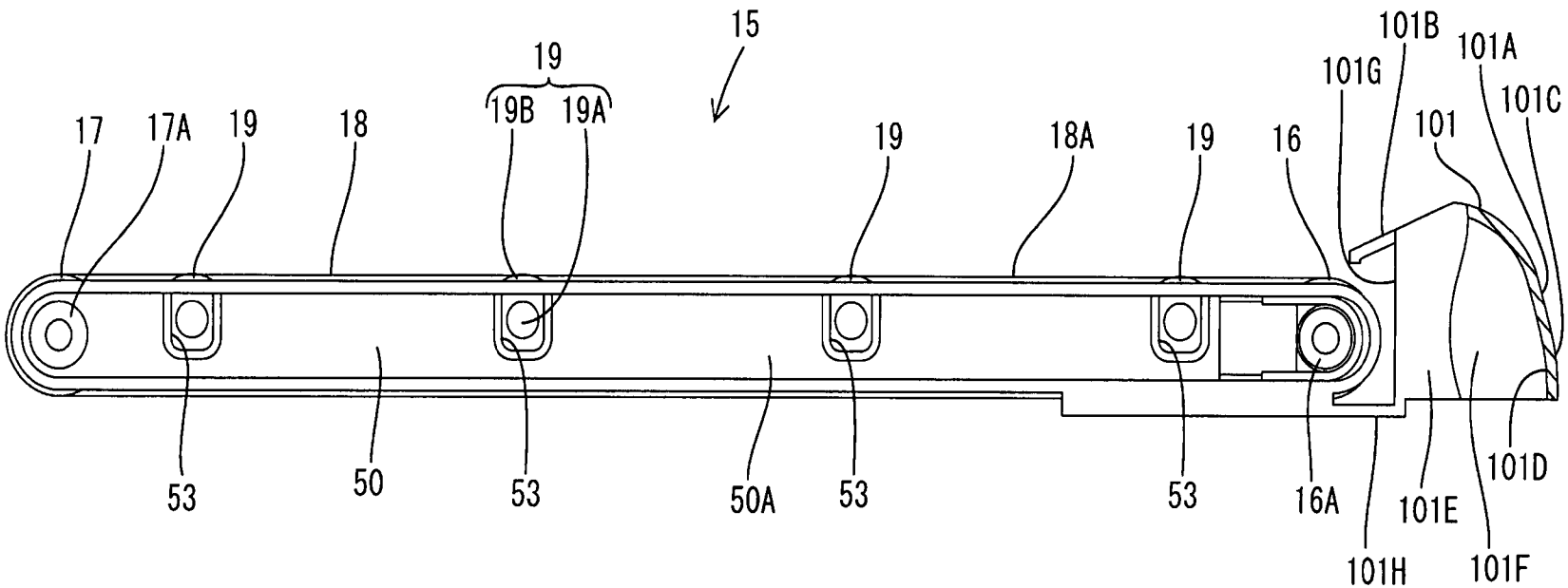
FIG. 4 is a side view showing a belt unit and a guide member of the laser printer shown in FIG. 1.

Referring to FIGS. 3 and 4, the belt unit 15 is provided with the carrier belt 18 for carrying the paper, the support rollers 16 and 17 for supporting the carrier belt 18, and a belt frame 50 that rotatably supports the support rollers 16 and 17.

The belt frame 50 formed of an insulated synthetic resin material includes side walls 50A and 50B at left and right sides, which are connected at the lower side. The support rollers 16 and 17 are supported at the front and rear ends of the belt frame 50, respectively. The support roller 17 is connected with a gear mechanism (not shown) provided in the body casing 2 upon installation of the belt unit 15 in the body casing 2, and driven by power of a motor (not shown) provided in the body casing 2.

The belt frame 50 is provided with four groove-like transfer roller fit portions 52 arranged in the longitudinal direction each extending in the lateral direction, and having the upper portion opened for accommodating the transfer roller 19. The transfer roller 19 is formed by coating a metal roller shaft 19A with a conductive rubber material 19B. Both ends of the roller shaft 19A extend from the left and right ends of the rubber material 19B. Referring to FIG. 4, roller shaft insertion holes 53 are formed through which the roller shaft 19A of the transfer roller 19 is inserted at the left and right ends of the transfer roller fit portion 52 in the left and right side walls 50A and 50B of the belt frame 50 as shown in FIG. 4. Each of the roller insertion holes 53 has a substantially rectangular shape, and dimensions in the vertical and longitudinal directions larger than the outer diameter of the roller shaft 19A. In the state where the belt unit 15 is detached from the body casing 2, the roller shaft 19A is allowed to be displaced in the radial direction (vertical and longitudinal directions) within the range of the roller shaft insertion hole 53.

A restriction member 55 is attached to the left end of the roller shaft 19A of the transfer roller 19 as shown in FIG. 3. The restriction member 55 is attached such that the roller shaft 19A is allowed to be inserted through the center cylindrical portion (not shown in detail). It is attached to be relatively rotatable around the axis of the roller shaft 19A, and not to be relatively shifted along the axial direction. The restriction member 55 is provided with a pair of plate-like restriction portions extending from the cylindrical portion thereof in the longitudinal direction (radial direction of the roller shaft 19A). The transfer roller fit portion 52 of the belt frame 50 has a groove portion 56 that extends in the longitudinal direction and opens upward, with which the plate-like restriction portion of the restriction member 55 is fit. The plate-like restriction portion of the restriction member 55 has a convex surface 55A with arc-like cross section of both side surfaces. The left and right convex surfaces 55A abut against the inner wall of the groove portion 56 such that the transfer roller 19 is positioned in the axial direction, and the sliding displacement of the roller shaft 19A in the radial direction (vertical and longitudinal directions) is allowed as well as the tilting thereof in the radial direction.

Referring to FIG. 4, the belt unit 15 of the example structure is combined with a guide member 101 for guiding the paper. Referring to FIGS. 1 and 2, the guide member 101 serves to guide the paper ejected by the pick-up roller 10 corresponding to the ejection mechanism installed in the body casing 2 onto the carrier belt 18. The guide member 101 and the belt unit 15 are combined into a single unit so as to be moveable with respect to the pick-up roller 10 and attachable to and detachable from the body casing 2.

Referring to FIG. 4, the guide member 101 has a portion (guide portion 101B) serving as a cover member that covers an upper portion of a carrier surface 18A of the carrier belt as well as a grip portion held by the operator for attachment or detachment of the belt unit 15.

The guide member 101 integrally formed with the side walls 50A and 50B of the belt frame 50 into a single unit to extend upstream of the carrier belt 18 in the carrier direction (front side of FIG. 1). The guide member 101 includes a guide surface 101C for guiding the paper, a curved portion 101A and the guide portion 101B. The curved portion 101A forms a portion of a carrier path that turns back the fed paper, which serves as a curved wall to form the upper convex portion.

The curved portion 101A is at the level that exceeds the height of the carrier belt 18. The guide portion 101B extends diagonally downward from the position higher than the carrier belt 18, and has an end portion opposite to the carrier surface 18A of the carrier belt 18. The guide member 101 and the belt frame 50 do not have to be formed as an integrally molded product so long as they are combined. For example, the guide member 101 and the belt frame 50 which are independently molded may be fixed together with a screw, for example.

The guide member 101 has an opening 101D that opens downward so as to allow fingers of the operator to be inserted from the lower portion thereinto. The space upward of the opening 101D is defined by the curved portion 101A, the guide portion 101B, and left and right side walls (In FIG. 4, one of the side walls, 101E is only shown). The guide portion 101B, and the left and right side walls 101E and 101F are continued with an rising wall portion 101G which is connected to the left and right side walls 50A and SOB of the belt frame 50 via a bottom wall 101H.

Referring to FIGS. 1 and 2, a tension mechanism 70 including a coil spring 54 is provided at the front end of the belt unit 15 at the side of the body casing 2. More specifically, the tension mechanism 70 is provided with a pair of left and right levers 71 having the center portion rotatably supported at a rotary shaft 71A along the lateral direction (one side is only shown in FIG. 1), and a pair of coil springs 54 each urging the respective levers 71 (one side is only shown in FIG. 1). Each of the coil springs 54 has the rear end fixed to the body casing 2, and the front end as a free end connected to the lower end portion of the respective levers 71. Each of the levers 71 has the upper end portion swingable against the elastic force applied by the coil spring 54. Two pairs of the levers 71 and the coil springs 54 are arranged to interpose the front end of the accommodated belt unit 15 between the pair of the levers 71.

The portion of the device for accommodating the belt unit 15 is provided with unit support portions 59 and 60 for positioning the belt unit 15. The unit support portion 59 supports a pair of left and right bearings 16A each of which supports the left end and right end of the roller shaft of the support roller 16 that extends from the frame 51 of the belt unit 15. A guide groove 60A is formed in the unit support portion 60 (see FIG. 1), through which a pair of bearings 17A each supporting the left end and right end of the roller shaft of the support roller 17 in the belt unit 15 is inserted. The aforementioned state represents the state where the belt unit 15 is normally installed in the body casing 2.

In the normally installed state as described above, the upper end of each of the levers 71 abuts against the bearing 16A of the belt support roller 16 from backside. The support roller 16 is urged in the direction (forward) where the belt support roller 16 is apart from the support roller 17 under the elastic force of the coil spring 54 so as to apply the tensile force to the carrier belt 18.

A belt tension release portion (not shown) is installed in the body casing 2, which retracts the upper portion of the lever 71 upon activation while expanding the coil spring 54 elastically so as to allow passage of the bearing 16A.

Figure 5A:
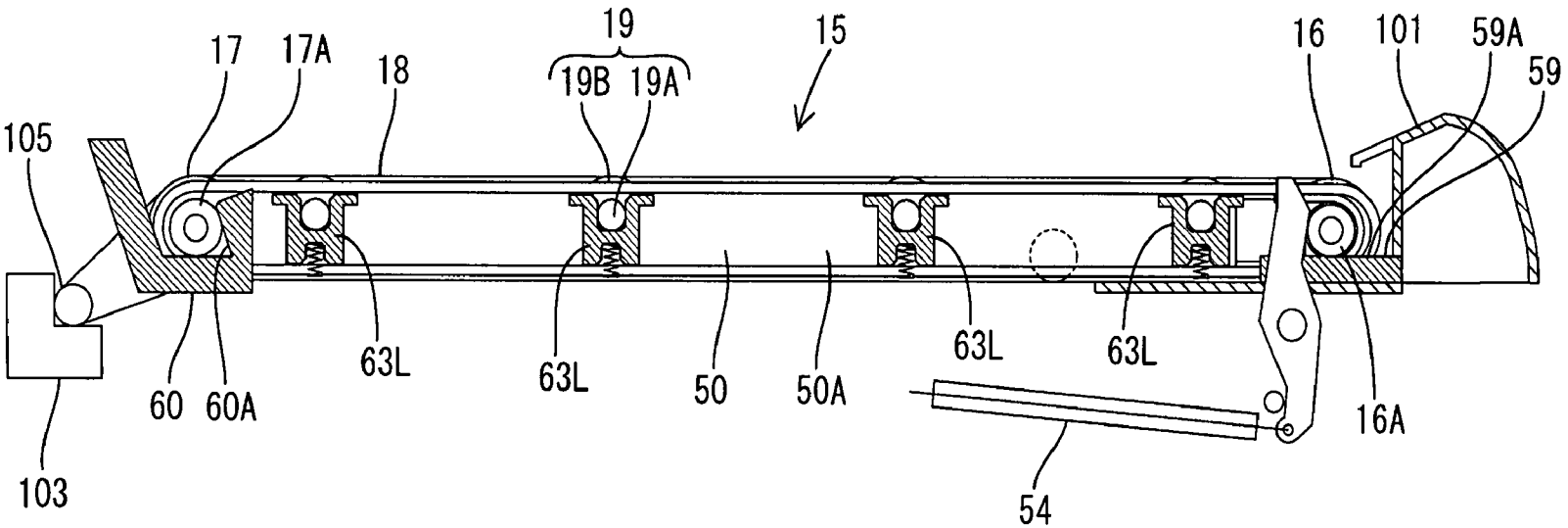
FIG. 5A is a sectional view showing a state where the belt unit and the guide member are installed in a body of the device.

Meanwhile, a metal frame 58 is provided within the body casing 2 so as to cover left and right sides of the process cartridges 26 and the belt unit 15, respectively. Pairs of the unit support portions 59 and 60 are provided at the front and rear portions of the frame 58, respectively as shown in FIG. 1. The unit support portion 60 at the rear side has the open upper portion with which a bearing 17A that rotatably supports the end of the belt support roller 17 at the rear side is fit as shown in FIG. 5A. As the bearing 17A is retained with the tension mechanism, the support roller 17 is held in position. The unit support portion 59 at the front side has a portion of the upper surface as a horizontal surface 59A at a constant height. The bearing 16A is disposed on the horizontal surface 59A such that the belt support roller 16 is held in position in the height direction. The horizontal surface 59A of the unit support portion 59 at the front side allows the longitudinal displacement of the belt support roller 16.

The frame 58 is provided with pairs of left and right bearing members 63L and 63R corresponding to the respective transfer rollers 19 for supporting the roller shafts 19A thereof at the left and right sides as shown in FIGS. 1 to 3. Each of the bearing members 63L and 63R has a bearing groove 64 with the upper portion opened, with which an end of the roller shaft 19A is fit from upward such that the roller shaft 19A is rotatably supported. A guide surface 65 is formed at the open edge of the bearing groove 64 into which the roller shaft 19A is introduced. The bearing member at the left side of the bearing members 63L and 63R shown in FIG. 3, that is, 63L is formed of an insulated synthetic resin material, and attached to the frame 58 so as to be allowed to have a vertical displacement. Meanwhile, it is held in position with respect to the longitudinal and lateral directions of the frame 58. A spring 66 is attached to the lower portion of the bearing member 63L so as to be urged upward by the spring 66.

The bearing member 63R at the right side of the drawing is formed of an electrically conductive synthetic resin material, and is attached to the insulated member 67 formed of the insulated synthetic resin material fixed to the frame 58 so as to be allowed to have a vertical displacement. Meanwhile, it is held in position with respect to the insulated member 67 in the longitudinal and lateral directions. The spring 66 having conductivity is attached to the lower portion of the right bearing member 63R at the right side so as to be urged upward thereby. The lower end of the spring 66 is connected to one end of an electrode plate 68. The other end of the electrode plate 68 extends outward from the frame 58, which is connected to the transfer bias application unit (not shown) provided within the body casing 2. The transfer bias application unit is electrically connected to the transfer roller 19 via the electrode plate 68, the spring 66, and the bearing member 63R such that the transfer bias is applied between the transfer roller 19 and the photosensitive drum 31 upon the image forming process.

The photosensitive drum 31 includes a drum shaft 31A extending from both ends of the drum body as shown in FIG. 3. Bearing bodies 80 each formed of the synthetic resin material are rotatably provided around the outer peripheries of the respective ends of the drum shaft 31A. The frame 58 includes drum positioning grooves 81 at left and right sides corresponding to the respective photosensitive drums 31. As the bearing body 80 is fit with each of the left and right drum positioning grooves 81, the drum shaft 31A is rotatably supported in position with respect to the frame 58. The drum shaft 31A is connected to a gear mechanism (not shown) within the body casing 2, and the photosensitive drum 31 is driven by a power of a motor (not shown).

Figure 6:
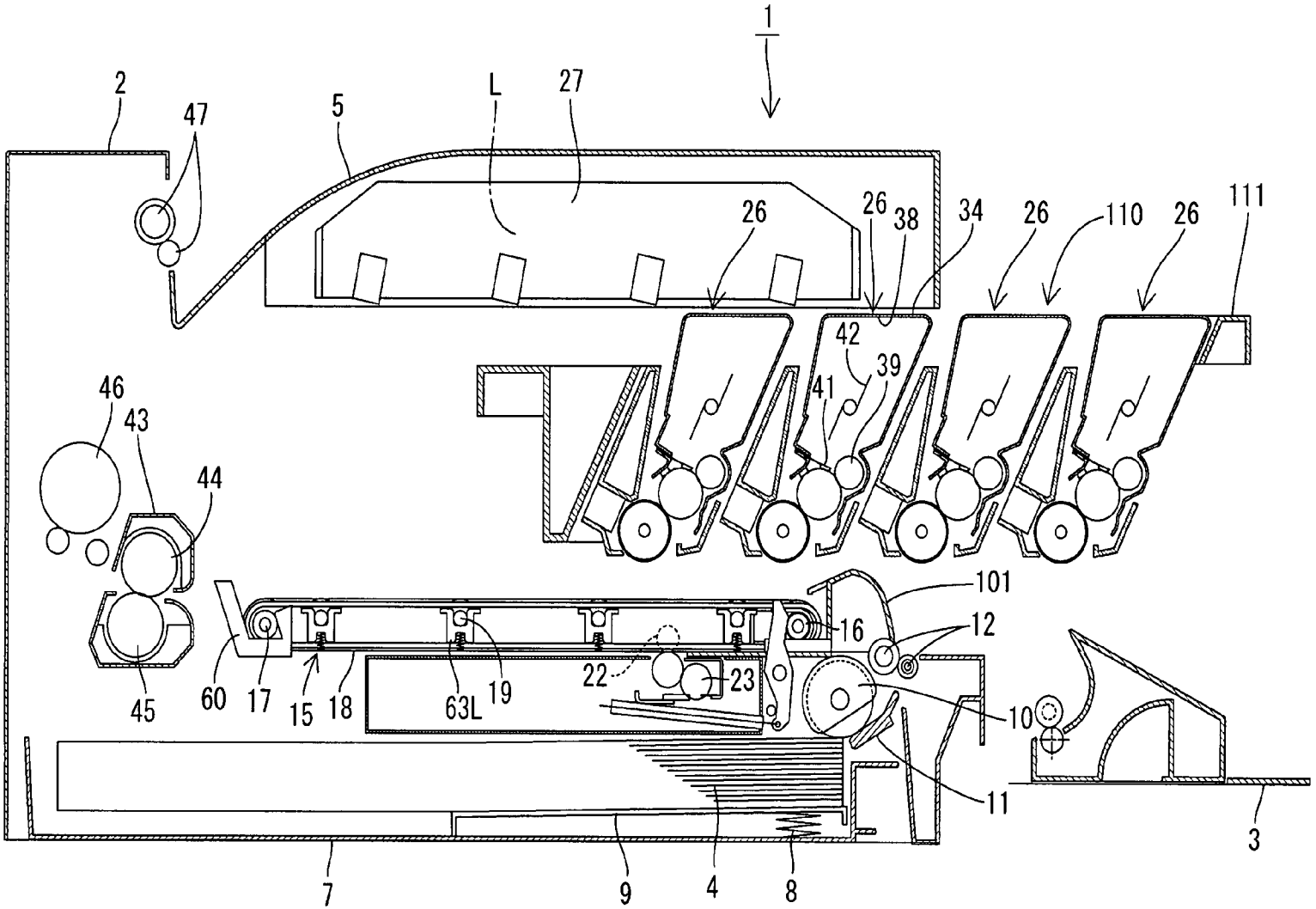
FIG. 6 is a sectional view of the laser printer shown in FIG. 1 in the state where an image forming unit is pull out.

The example structure has a frame 111 that holds four process cartridges 26 within the body casing 2. Referring to FIG. 6, an image forming unit 110 formed of the frame 111 and those four process cartridges 26 may be detached from an opening 2A formed in the body casing 2. In order to detach the carrier belt 18, the front cover 3 is opened as shown in FIG. 2, and the image forming unit 110 is pulled out as shown in FIG. 6 so as to have access to the belt unit 15 via the opening 2A.

Figure 7:
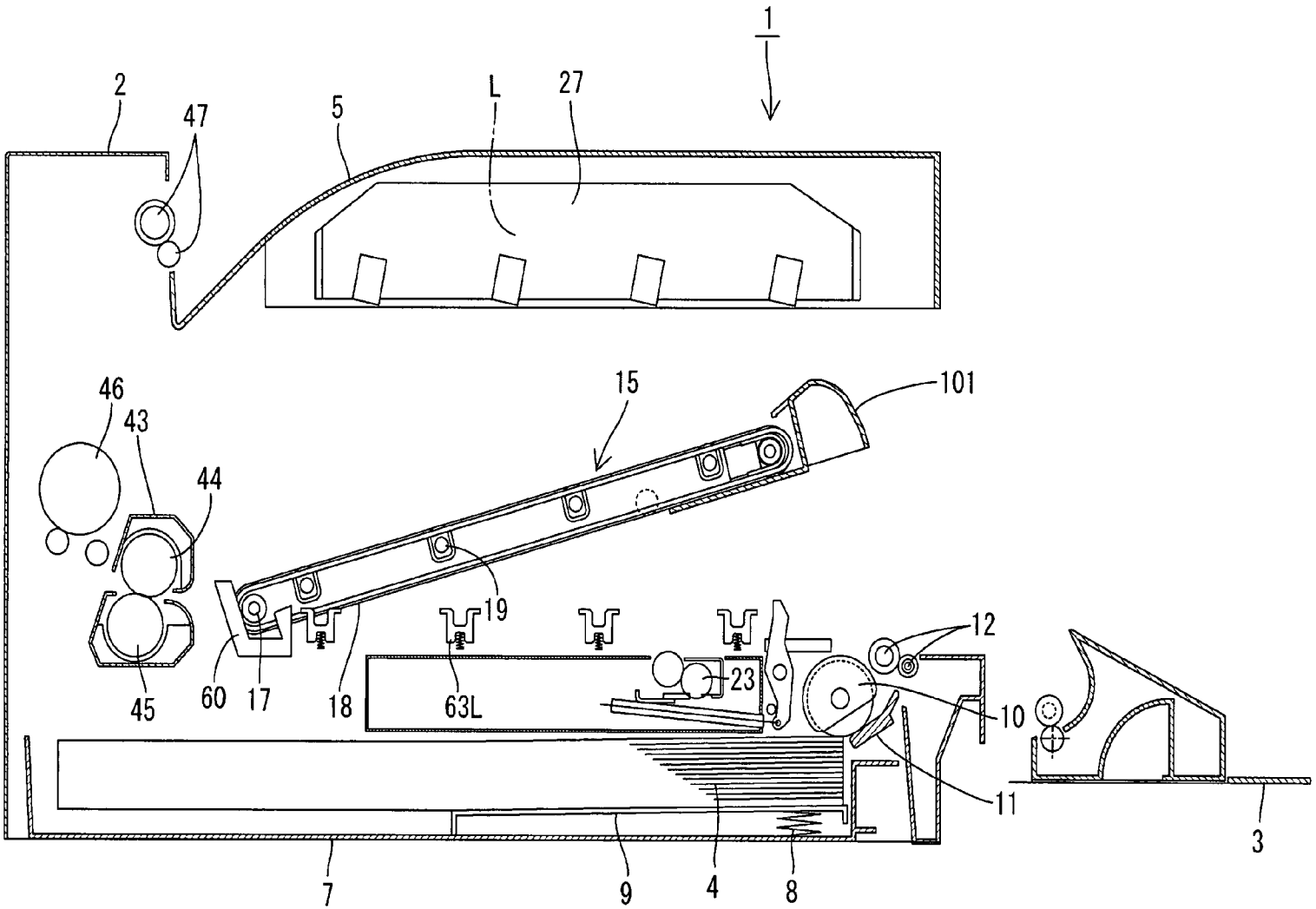
FIG. 7 is a sectional view of the laser printer shown in FIG. 1 in the state where the belt unit is displaced from its set position.
Figure 8:
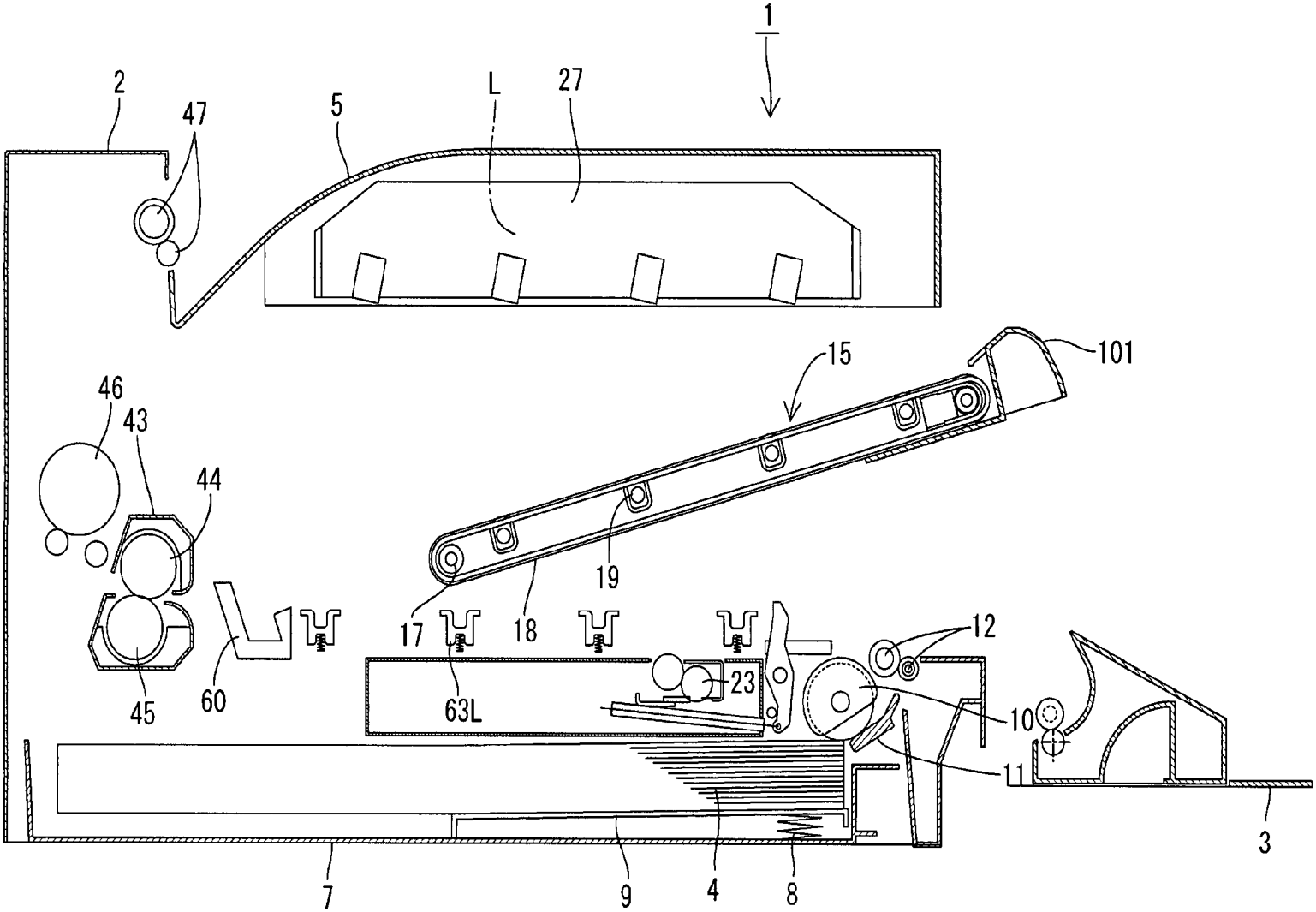
FIG. 8 is a sectional view of the laser printer shown in FIG. 1 in a state where the belt unit is completely detached.

The belt unit 15 is detachable with respect to the body casing 2 via the opening 2A in the state where the image forming unit 110 is detached from the body casing 2 as shown in FIGS. 7 and 8. In the example structure, as the guide member 101 combined with the belt unit 15 is at the position closer to the opening 2A than the carrier belt 18. Pulling out the image forming unit 110 allows easy access to the guide member 101 via the opening 2A. Accordingly, the belt unit 15 may be easily detached from the body casing 2 while gripping the guide member 101.

Figure 5B:
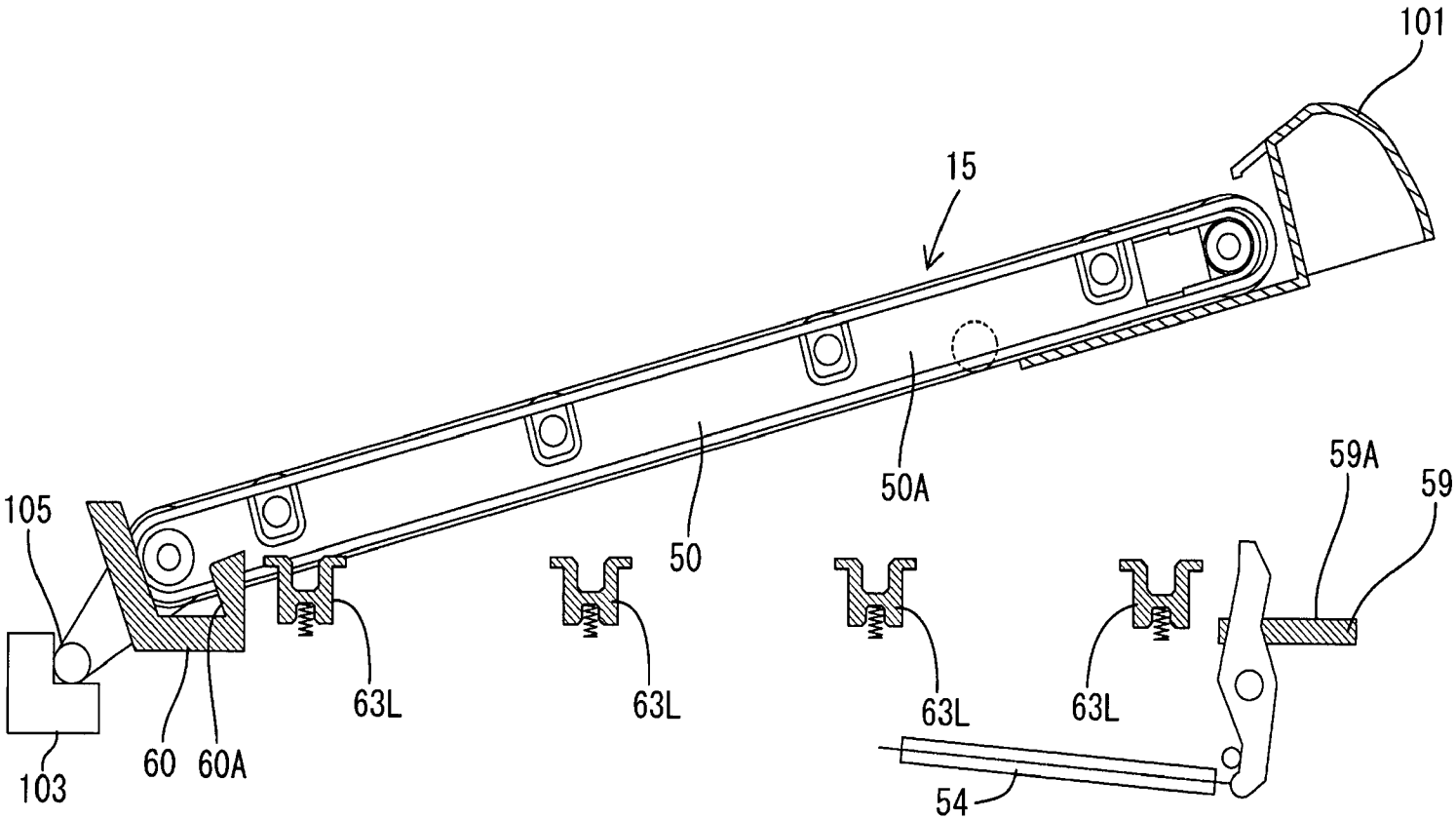
FIG. 5B is a sectional view showing a state where the belt unit and the guide member are detached from the body.

Referring to FIG. 5A, a pivot shaft 105 is supported by one of a pair of support portions 103 at the left and right sides of the body of the apparatus at a position different from that of the rotary shaft of the support roller 17, opposite to the side where the guide member 101 combined with the belt unit 15 is provided. The pivot shaft 105 extends in parallel with the rotary shaft of the support roller 17, having the rear lower portion of both left and right ends supported at the pair of support portions 103. In the example structure, when the belt unit 15 is pivotally turned with respect to the pivot shaft 105 while lifting up the guide member 101 as shown in FIG. 5B, the rotary shaft (roller shaft) of the support roller 17 and the bearing 17A displace upward to go through the guide groove 60A of the unit support portion 60 such that the belt unit 15 is allowed to be detached from the installed position.

Meanwhile, the belt unit 15 is inserted through the opening 2A to allow the bearings 17A at both ends of the rear support roller 17 to be engaged with the guide groove 60A of the unit support portion 60, and the bearings 16A at both ends of the front support roller 16 to be placed on the unit support portion 59 for the purpose of installing the belt unit 15 into the body casing 2. This makes it possible to hold the belt unit 15 in a horizontal state by the unit support portions 59 and 60 arranged in the longitudinal direction. In the aforementioned process, both end portions of the roller shaft 19A of each transfer roller 19 are guided into the bearing grooves 64 formed in the bearing members 63L and 63R so as to be fit therewith. This makes it possible to have the respective transfer rollers 19 positioned in the longitudinal direction.

Then the image forming unit 110 is slidably placed inside to install the respective process cartridges 26 upward of the belt unit 15. The bearing bodies 80 at both ends of the drum shaft 31A are fit with the respective drum positioning grooves 81 of the frame 58 so as to have the photosensitive drum 31 to be positioned with respect to the frame 58. As the transfer roller 19 is pressed downward by the photosensitive drum 31 against the urging force applied by the spring 66, the transfer roller 19 may be positioned in the vertical direction.

In the above-described structure, the belt unit 15 is combined with the guide member 101 that guides the paper, which are moveable with respect to the pick-up roller 10, and attachable and/or detachable with respect to the body casing. As the guide member 101 that guides the paper to the carrier belt 18, and the belt unit 15 are combined, the accuracy in positioning of the guide member 101 and the carrier belt 18 may be effectively improved. When the belt unit 15 is attached or detached, the guide member 101 functions as the grip portion. Accordingly the guide member 101 and the belt unit 15 in combination may be attached to or detached from the body casing as the moveable unit with respect to an ejection mechanism. This makes it possible to allow easy attachment or detachment of the belt unit 15 as well as improvement of the maintenance operation.

A portion of the guide member 101 serves as a cover member that covers the carrier surface 18A of the carrier belt 18 so as to prevent the contact between the operator's hand and the carrier belt 18. As the guide member 101 extends to the position closer to the opening 2A than the carrier belt 18, it becomes closer to the opening 2A than the carrier belt 18. This makes it possible to allow easy access to the guide member 101 during detachment of the belt unit 15. The belt unit 15 may be installed with no need of deep insertion of the operator's hand. The attachment or detachment of the belt unit, thus, may be easily performed.

The pivot shaft 105 is supported by the support portion 103 of the apparatus at a position different from that of the rotary shaft of the support roller 17, opposite to the side where the guide member 101 combined with the belt unit 15 is provided. The belt unit 15 is pivotally operated around the pivot shaft 105 so as to be detached from the device. Accordingly, the belt unit 15 may be easily detached by operating the guide member 101.

In the body casing 2, the image forming unit 110 formed on frame 111 that supports a plurality of cartridges is detachably held at the frame 111 and is allowed to be pulled out from the body casing 2. The aforementioned image forming unit 110 may be detached from the opening 2A formed in the body casing 2. The belt unit 15 may be attached or detached with respect to the body casing 2 via the opening 2A in the state where the image forming unit 110 is detached from the body casing 2. This makes it possible to perform the maintenance of the belt unit 15 independently from the image forming unit 110 while using the opening 2A for attachment or detachment of both units.

In the example structure, the paper feed tray 7 is allowed to be pulled out from the body casing 2 at one side surface (that is, front surface side). The front cover 3 that is capable of opening and closing the opening 2A formed in the body casing 2 is provided on the side surface (front surface) from where the paper feed tray 7 is pulled out. The belt unit 15, thus, is allowed to be attached or detached via the opening 2A. The above-described structure allows both detachment of the belt unit 15 and withdrawal of the paper feed tray 7 to be performed from the same side, resulting in considerably convenient structure.

Another example structure of the present invention will be described referring to FIGS. 9 to 12.

The example structure is a color laser printer 80 of intermediate transfer tandem type using an intermediate transfer belt 86. The components of the structure which are the same as those described in the aforementioned example will be designated with the same reference numerals, and the explanation thereof, thus, will be omitted.

The laser printer 80 includes a belt unit 81 that is attachable to and detachable from the body casing 2. The belt unit 81 has a belt frame 82 formed of an insulated synthetic resin material with a substantially triangle side view. Belt support rollers 83, 84, and 85 are provided at the front end, rear end and lower end of the belt frame 82, respectively, by which an intermediate transfer belt 86 extends thereamong. Four transfer rollers 19 are arranged on the upper surface of the belt frame 82. A secondary transfer roller 87 opposite to the belt support roller 85 at the lower end of the belt frame 82 with respect to the intermediate transfer belt 86 is provided at the lower portion of the belt unit 81. The secondary transfer bias is applied between the secondary transfer roller 87 and the belt support roller 85. In the laser printer 80, the toner image generated by four photosensitive drums 31 is transferred onto the intermediate transfer belt 86 in four colors, and thereafter, the toner image transferred onto the intermediate transfer belt 86 is further transferred onto the paper 4 while passing through the press contact position between the secondary transfer roller 87 and the intermediate transfer belt 86. The intermediate transfer belt 86 functions as the carrier belt that grips the paper 4 with the secondary transfer roller 87 so as to be carried in the belt running direction and to transfer the toner image thereon.

Figure 9:
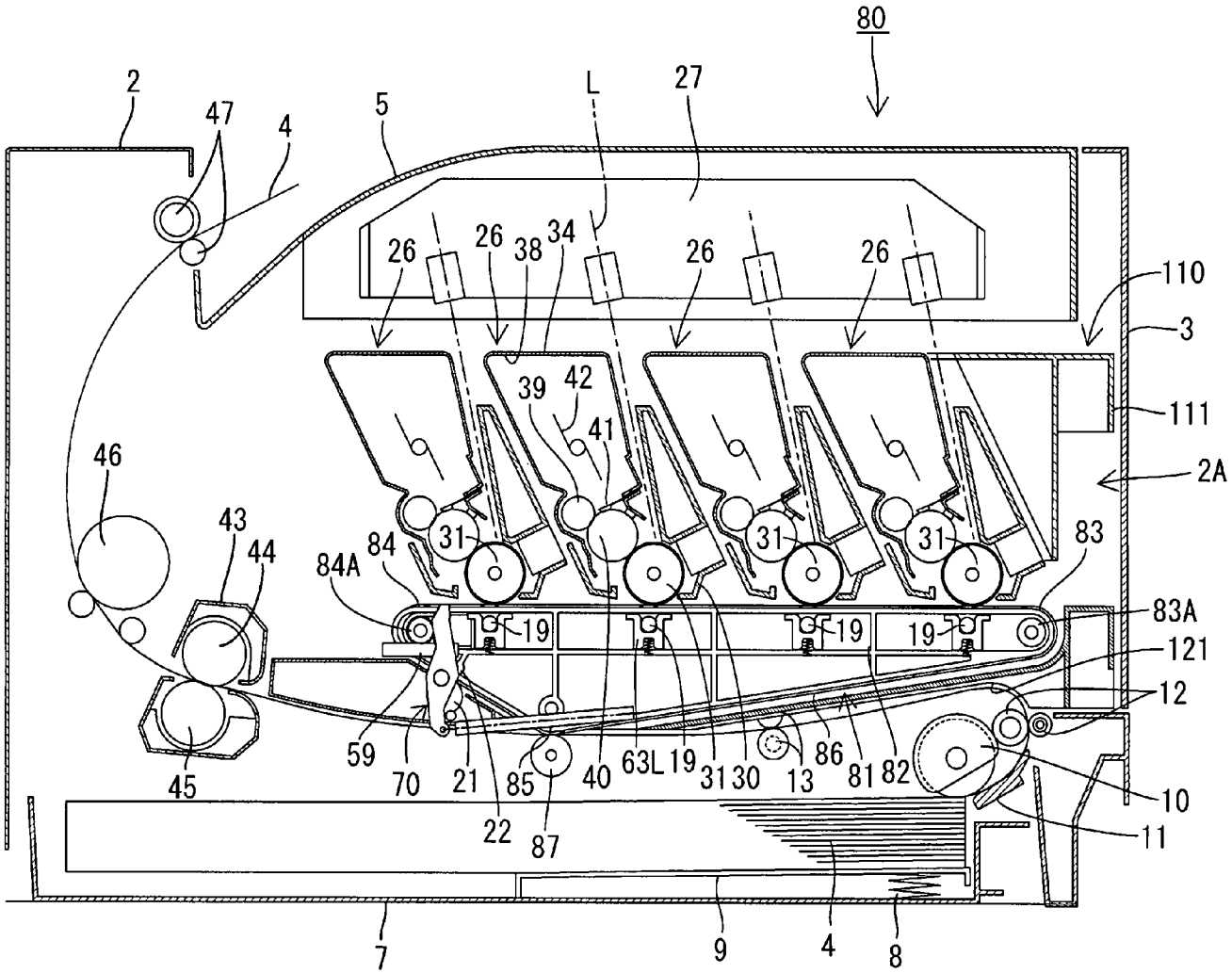
FIG. 9 is a sectional view schematically showing another example structure of the laser printer according to the present invention.

A frame (not shown) within the body casing 2 is provided with a pair of unit support portions at the front and rear sides for supporting the belt support rollers 83 and 84 at the front and rear sides, respectively. In the example shown in FIG. 9, the unit support portion 59 that supports the support roller 84 is only shown, and the unit support portion that supports the support roller 83 is not shown. However, the example may have the same structure as that of the unit support portion 60 shown in FIG. 1. The frame is also provided with a pair of bearing members corresponding to the transfer roller 19 at left and right sides for supporting the roller shaft 19A of the transfer roller 19. The example of FIG. 9 shows one of those bearing members, that is, the bearing member 63L only.

Figure 11:
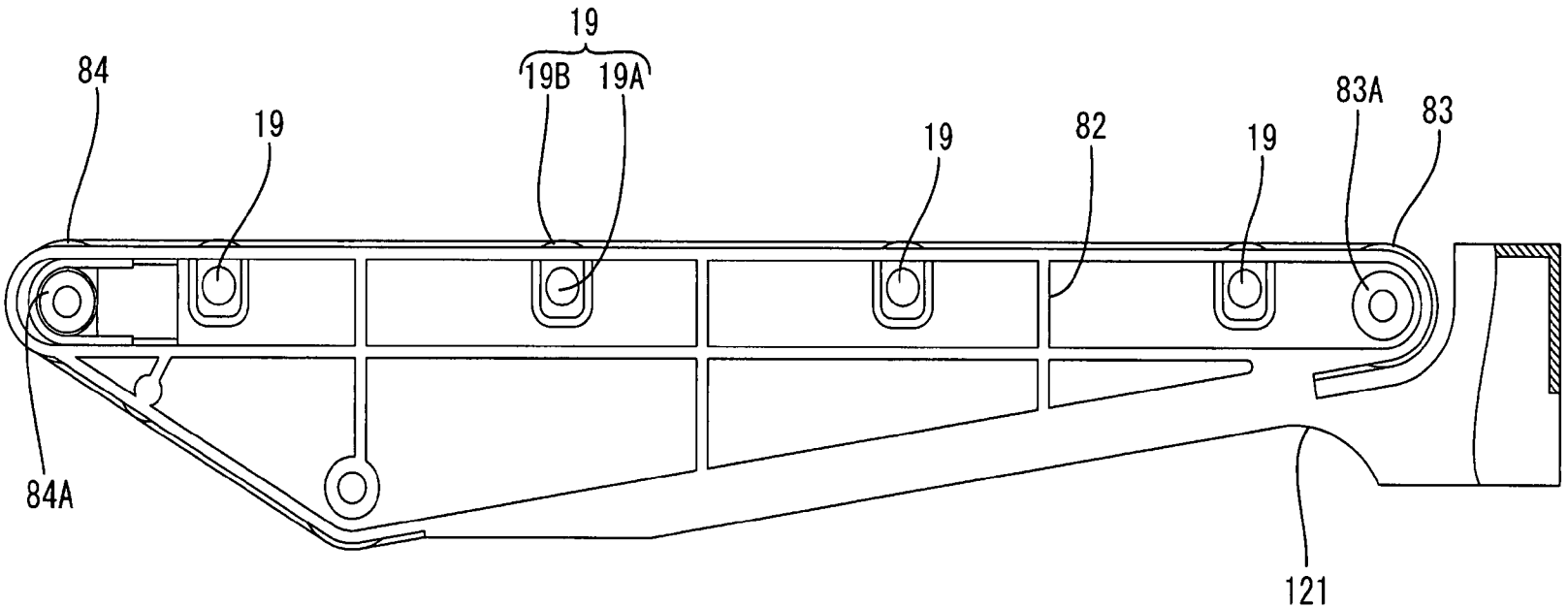
FIG. 11 is a sectional view showing the belt unit and the guide member of the laser printer in FIG. 9.
Figure 12:
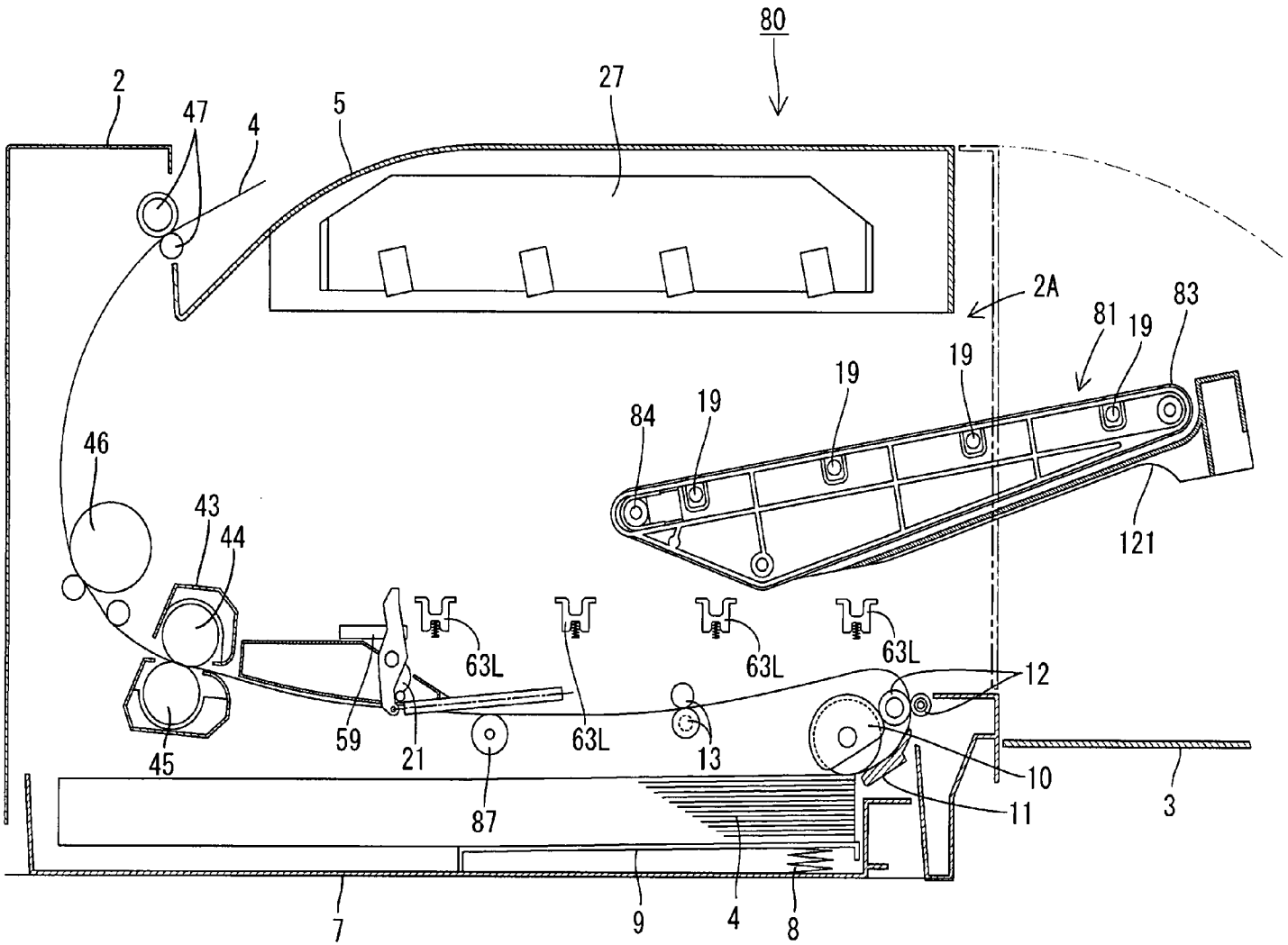
FIG. 12 is a sectional view of the laser printer shown in FIG. 9 in the state where the belt unit is completely detached.

In the example structure shown in FIG. 11, the belt unit 81 is combined with a guide member 121 that guides the paper. Referring to FIG. 12, the guide member 121 and the belt unit 81 can move in combination with respect to the pick-up roller 10, and are attachable and/or detachable with respect to the body casing. As the guide member 121 that guides the paper into the intermediate transfer belt 86 is combined with the belt unit 81, the accuracy in positioning of the guide member 121 and the intermediate transfer belt 86 is improved to higher degrees. Moreover, upon attachment or detachment of the belt unit 81, a portion of the guide member 121 is allowed to function as the grip portion. This makes it possible to perform attachment or detachment of the guide member 121 and the belt unit 81 in combination with respect to the body casing 2.

The guide member 121 extends upstream of the intermediate transfer belt 86 in the carrier direction with respect to the secondary transfer roller 87. This may eliminate the need of accessing the area around the carrier surface of the intermediate transfer belt 86 for locating a position to grip during attachment or detachment. Thus, interaction on the carrier surface is unlikely, thus providing more protection to the carrier belt.

Figure 10:
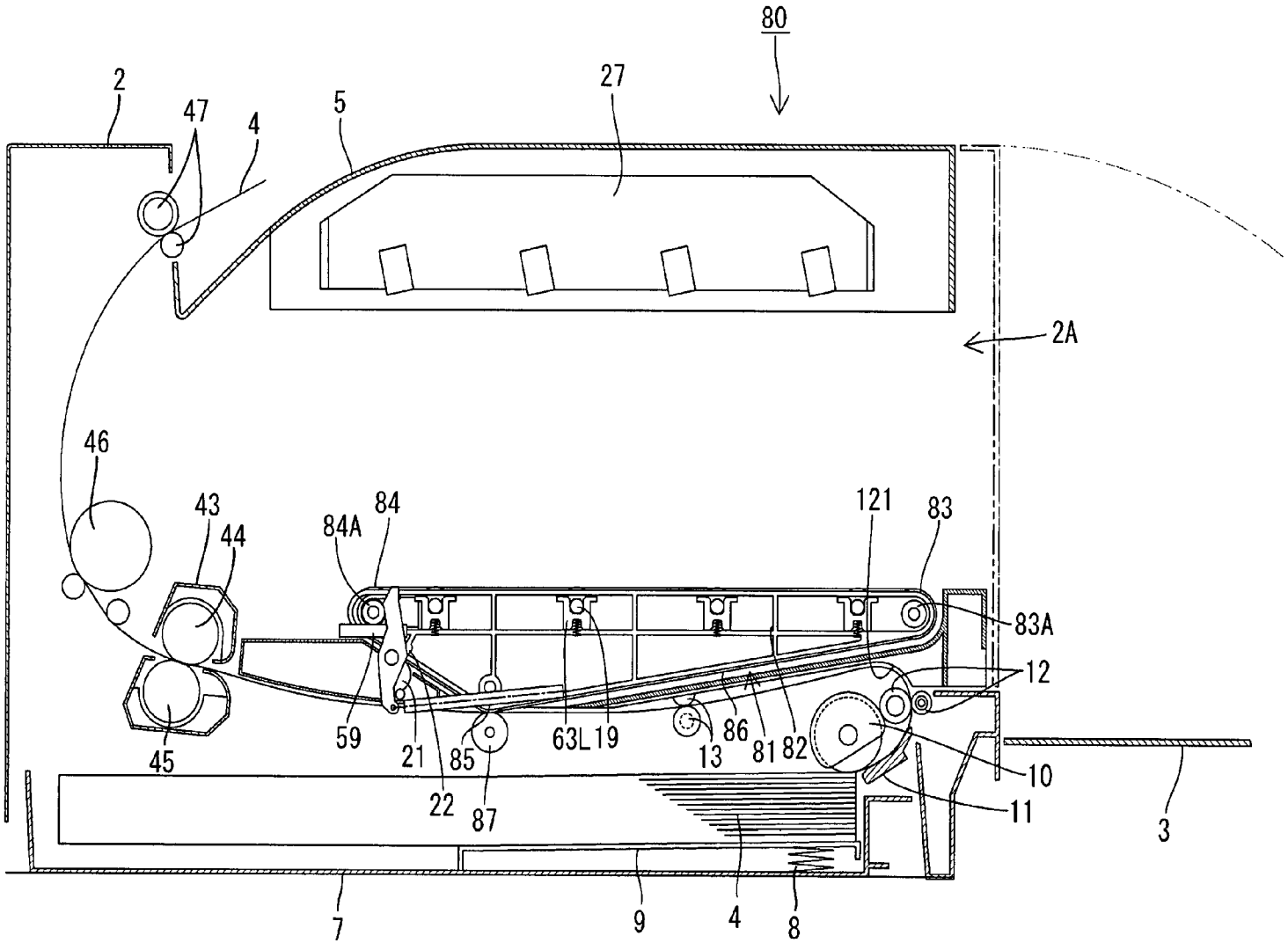
FIG. 10 is a sectional view of the laser printer shown in FIG. 9 in the state where the front cover is opened, and the image forming unit is detached.

Referring to FIG. 10, the opening 2A is formed in a portion of the body casing 2. Referring to FIG. 12, the belt unit 81 is detachably provided with respect to the body casing via the opening 2A. The guide member 121 is arranged at the position closer to the opening 2A than the intermediate transfer belt 86. As the guide member 121 is closer to the opening 2A than the intermediate transfer belt 86, access to the guide member 121 is improved, thus making it easier for attaching and/or detaching the belt unit 81. The belt unit 81 may be easily attached with no need of inserting the operator's hand so deeply. This makes it possible to perform the attachment or detachment of the belt unit easily.

An image forming unit 110 formed of a frame 111 that supports a plurality of pairs of process cartridges 26 is detachably held by frame 111 and is allowed to be pulled out from the body casing 2. The image forming unit 110 is allowed to be attached to and detached from the opening 2A of the body casing 2 as shown in FIG. 10. The belt unit 81 is detachably provided with respect to the body casing 2 via the opening 2A as shown in FIG. 12 in the state where the image forming unit 110 is detached from the body casing 2 as shown in FIG. 10. The belt unit 81 may be maintained independent from the image forming unit 110, thus using the opening 2A for attachment or detachment of both the image forming unit and the belt unit, respectively.

In the example structure, the paper feed tray 7 may be pulled out from one side surface (that is, front surface side) of the body casing 2. The front cover 3 serving to open and close the opening 2A formed in the body casing 2 is provided at the one side surface (front surface) from where the paper feed tray 7 is pulled out. The belt unit 81 may be detachably provided at the one side surface via the opening 2A. The detachment of the belt unit 81 and withdrawal of the paper feed tray 7 may be performed from the same side, resulting in the structure with improved convenience.

the combination of the belt unit and the guide member described herein may be formed as an integrally molded product of the part of the belt unit (for example, frame) and the guide member. Alternatively, it may be structured by fixing an independent guide member to the part of the belt unit (for example, frame).

What is claimed is:

1. An image forming apparatus comprising:

a body casing that accommodates a storage portion for storing a recording medium in a bottom portion of said body casing, and an image forming unit that forms an image on said recording medium;

an opening formed in a side portion of said body casing;

an ejection mechanism provided within said body casing for ejecting said recording medium stored in said storage portion;

a guide member that guides said recording medium ejected by said ejection mechanism in a predetermined direction;

a belt unit, said belt unit carrying said recording medium guided by said guide member toward said image forming unit, wherein:

said belt unit further includes a frame portion, a plurality of support rollers rotatably provided to said frame portion, and a carrier belt extended between said support rollers for carrying said recording medium guided by said guide member;

at least a portion of said guide member is arranged at a position closer to said opening than said carrier belt with said belt unit installed in the body casing;

said image forming unit is configured to be removed from said body casing through said opening independent of said belt unit, and said guide member and said belt unit are combined and are attachably and detachably provided with respect to said body casing via said opening.

2. The image forming apparatus according to claim 1, wherein a portion of said guide member covers a carrier surface of said carrier belt.

3. The image forming apparatus according to claim 2, wherein said guide member extends in a carrier direction at one of upstream and downstream of said carrier belt.

4. The image forming apparatus according to claim 2, wherein said image forming unit includes a photosensitive drum and a development unit provided upward of said belt unit within said body casing.

5. The image forming apparatus according to claim 4, wherein a storage member for storing said recording medium at one side surface of said body casing is provided so as to be pulled out and a cover member allowed to open and close said opening formed in said body casing is provided at said one side surface from where said storage member is pulled out.

6. An image forming apparatus comprising:

a body casing that accommodates a storage portion for storing a recording medium in a bottom portion of said body casing, and an image forming unit that forms an image on said recording medium;

an opening formed in a side portion of said body casing;

an ejection mechanism provided within said body casing for ejecting said recording medium stored in said storage portion;

a guide member that guides said recording medium ejected by said ejection mechanism in a predetermined direction;

a belt unit, said belt unit carrying said recording medium guided by said guide member toward said image forming unit, said belt unit further including a frame portion, a plurality of support rollers each being provided to said frame portion and having respective rotary shafts laterally extending from said frame portion, and a carrier belt extended between said support rollers for carrying said recording medium guided by said guide member; and a bearing member provided at a side of said body casing, which rotatably supports the rotary shafts of said support rollers in a positioned state, wherein:

said guide member and said belt unit in combination are attachably and detachably provided with respect to said body casing via said opening, and at least a portion of said guide member is arranged at a position closer to said opening than said carrier belt with said belt unit installed in the body casing, wherein said image forming unit is configured to be detached from the body casing through said opening independent of said belt unit.

7. The image forming apparatus according to claim 6, wherein said belt unit is provided with a pivot shaft at an end portion opposite to a side where said guide member is provided, and a support portion that pivotally supports said pivot shaft provided within said body casing.

8. The image forming apparatus according to claim 7, wherein a portion of said guide member covers a carrier surface of said carrier belt.

9. The image forming apparatus according to claim 6, wherein said guide member extends in a carrier direction at one of upstream and downstream of said carrier belt.

10. The image forming apparatus according to claim 6, wherein said image forming unit includes a photosensitive drum and a development unit provided upward of said belt unit within said body casing.

11. The image forming apparatus according to claim 10, wherein a storage member for storing said recording medium at one side surface of said body casing is provided so as to be pulled out, and a cover member allowed to open and close said opening formed in said body casing is provided at said one side surface from where said storage member is pulled out.

* * * * *